United States Patent [19]

Wilhelm

[11] 4,302,996

[45] Dec. 1, 1981

[54] APPARATUS AND METHOD FOR DETERMINING WIRE BLANK LENGTH

[75] Inventor: Donald F. Wilhelm, Toledo, Ohio

[73] Assignee: Helm Instrument Company, Inc., Toledo, Ohio

[21] Appl. No.: 93,194

[22] Filed: Nov. 13, 1979

[51] Int. Cl.[3] ..... B26D 5/40

[52] U.S. Cl. ..... 83/212; 83/198; 83/370; 83/42

[58] Field of Search ..... 83/198, 210, 211, 212, 83/361, 363, 367, 368, 369, 370, 391, 467, 42; 10/25, 72 R; 73/133 R, 141 A; 33/DIG. 13

[56] References Cited

U.S. PATENT DOCUMENTS

| | | | |
|---|---|---|---|
| 2,247,766 | 7/1941 | Boerger | 83/212 X |
| 2,568,438 | 9/1951 | Friedman | 83/198 X |
| 3,153,772 | 10/1964 | Dorr | 73/141 A |
| 3,252,364 | 5/1966 | Veres et al. | 83/198 X |
| 3,400,622 | 9/1968 | Olsen | 83/212 X |
| 3,426,631 | 2/1969 | Sandberg | 83/212 X |
| 3,621,927 | 11/1971 | Ormond | 73/141 A X |
| 3,968,683 | 7/1976 | Ormond | 73/141 A |
| 4,011,779 | 3/1977 | Berg | 83/212 X |
| 4,079,624 | 3/1978 | Kurtz | 73/141 A |

FOREIGN PATENT DOCUMENTS

| | | | |
|---|---|---|---|
| 504277 | 7/1930 | Fed. Rep. of Germany | 10/25 |
| 50774 | 5/1966 | Fed. Rep. of Germany | 83/198 |
| 2401409 | 7/1975 | Fed. Rep. of Germany | 83/212 |

*Primary Examiner*—Frank T. Yost
*Assistant Examiner*—Robert P. Olszewski
*Attorney, Agent, or Firm*—Wilson, Fraser, Barker & Clemens

[57] ABSTRACT

A method and apparatus for detecting the length of wire blanks in a wire cutting machine is disclosed, the machine including feed apparatus for feeding wire stock into the cutting machine, stop apparatus for engaging one end of the wire stock at a predetermined length in the cutting machine, and cutting apparatus for cutting wire blanks from the wire stock. When the leading end of the wire stock engages the stop apparatus with a predetermined pressure, the blank is at a proper length to be cut. The pressure causes the stop apparatus to expand radially. Strain gauges mounted about the stop apparatus detect the expansion by generating an electrical signal when connected in a bridge circuit. The strain gauges detect an over feed situation when the stop apparatus expands beyond a predetermined point. Similarly, an under feed situation is detected when little or no expansion of the stop apparatus is sensed. The strain gauge signal is utilized by the machine operator or automatic control apparatus to control the feed apparatus whereby wire blanks are cut at the desired length. The stop apparatus includes a cylindrical member having a threaded axial aperture formed therein for receiving a screw having one end for receiving the pressure and the other end slotted for adjusting the blank length.

11 Claims, 5 Drawing Figures

APPARATUS AND METHOD FOR DETERMINING WIRE BLANK LENGTH

BACKGROUND OF THE INVENTION

1. Field of the Invention

The present invention relates in general to wire cutting machines and in particular to an apparatus and method for detecting the length of a wire blank in a wire cutting machine.

2. Description of the Prior Art

The strain gauge is a well known device in the prior art. The application of strain to the gauge causes changes in the electrical resistance of the conducting elements which are proportional to amount of applied strain. For example, U.S. Pat. No. 2,036,458 to Carlson discloses a telemetric device for determining dimensional changes in a structure. The device includes two spaced anchoring members connected by a framework carrying a pair of coils of wire under tension. As the two anchoring members are moved relative to each other, the tension in the coils changes and the resistivity of the wire is proportionally altered.

The strain gauge has many applications in mechanical devices. U.S. Pat. No. 2,442,938 to Ruge discloses a fluid pressure responsive apparatus utilizing electrical strain gauges. Fluid pressure is introduced to the interior of a bellows which is mounted at one end upon a rigid base. The other end of the bellows is freely movable and is engaged with a strain sensitive cantilever beam which is also mounted on the rigid base. As the fluid pressure changes, the bellows causes the cantilever beam to be displaced. Strain gauges mounted on the beam provide an electrical signal which is proportional to the amount of displacement of the beam.

U.S. Pat. No. 4,123,847 to Bosselaar discloses an apparatus for measuring the internal corrosion in pipelines including a pig having a circumferential array of spring-loaded probes for measuring both the average diameter of the pipe and the depth of individual pits. The probes are held against the inside surface of the pipe by spring means. The springs are fitted with strain gauges which receive the tension on the springs. The resistivity of the strain gauges changes proportionally with the tension of the spring and provides an electrical signal representing the amount of movement by the probes.

SUMMARY OF THE INVENTION

The present invention relates to an apparatus and a method for detecting the length of wire blanks in a wire cutting machine. Wire stock is fed into the machine by a plurality of feed rolls. The leading end of the wire stock engages a stop means located a predetermined distance past a cutter. When the leading end of the wire stock engages the stop means with a predetermined pressure, the length of the wire blank is proper and the feed of the wire stock is halted so that the cutter can shear off the wire blank. The cutter retracts and the wire blank is ejected and transferred to a series of dies which form the wire blank to a desired configuration.

The amount of wire which is fed into the cutter during each cycle is determined by the amount of rotation of the feed rolls and the position of the stop means. The amount of feed roll rotation can be adjusted, but the adjustment is imprecise and the consequences of improper wire feed are great. Excessive overfeeding causes the feed rolls to slip on the wire, damaging the lubricative wire coating and causing increased wear of the feed roll grooves. If the feed rolls do not turn enough, the wire stock will stop before engaging the stop means and the cutoff length of the wire blank will be too short. Not only does this cause a defective piece, but a small blank can easily jam in the machine and possibly break expensive dies and other equipment. Attempts to sense the presence of the leading end of the wire blank at the stop means utilizing electrical contacts have failed because of the presence of metal shavings in the area. Similarly, other detection methods, such as the use of proximity probes or air gauges, have met with little success.

The present invention detects the wire blank length by utilizing a plurality of strain gauges located about the stop means. When the leading edge of the wire stock engages the stop means, typically a stock gauge screw with a punch pin, pressure is applied axially by the wire stock. The stock gauge screw is threaded within a rigid support which militates against further axial movement. The increased pressure causes a radial expansion of the stock gauge screw and its threaded receiver. Strain gauges mounted about the axial periphery of the receiver sense the increased pressure and alter an electrical signal proportionately. When the pressure increases beyond a predetermined point, an over feed situation is detected and a signal can be generated to halt the feed rolls. Likewise, if the leading end of the wire stock either has not engaged or has lightly engaged the stop means, an under feed situation is detected because the strain gauge does not detect a minimum amount of expansion. Thus, a signal can be generated to continue rotation of the feed rolls. When the strain gauges sense expansion within predetermined maximum and minimum values, a good blank is detected and the feed rolls are instructed to stop and the cutter is engaged to shear the blank off. The blank is then transferred to dies where it can be formed to a desired configuration.

It is an object of the present invention to improve the operation of the feed length mechanism of wire cutting machines.

It is another object of the present invention to increase the efficiency and accuracy of wire cutting machines.

It is a further object of the present invention to protect the dies and other expensive forming equipment by providing a reliable wire blank length detector.

Further objects and advantages of the present invention will become apparent to those skilled in the art from the following detailed description of the preferred embodiment of the invention when read in the light of the accompanying drawings.

DETAILED DESCRIPTION OF THE PREFERRED EMBODIMENT

Figure 1:
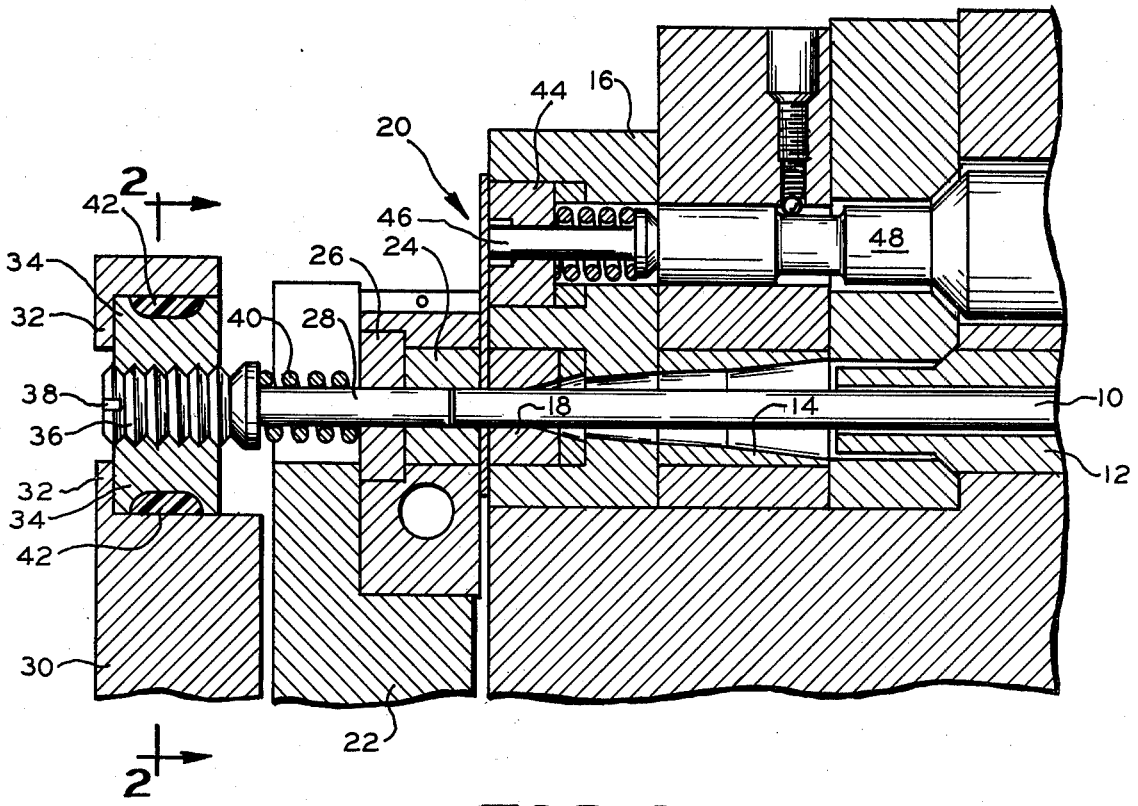
FIG. 1 is an elevational sectional view of a portion of a wire cutting machine having a wire blank length detector according to the present invention.

Referring to FIG. 1, there is shown a wire cutting machine having a wire blank length detector according to the present invention. Feed means are provided to feed wire stock into the wire cutting machine. In the preferred embodiment, wire stock 10 enters the wire cutting apparatus through a plurality of feed rolls (not shown). The feed rolls frictionally engage the wire stock 10 and advance it axially through a feed tube 12 to a cutting area. A wire guide 14 further directs the wire stock 10 into a stationary quill block 16. The quill block 16 rigidly holds a cutoff quill 18. The quill block 16 can also house a first die assembly, which is indicated generally at 20.

The leading end of the wire stock 10 passes through the quill 18 into a movable cutter block 22. The cutter block 22 houses a cutter 24, a cutter filler 26, and a stock gauge pin 28. The cutter filler 26 is an interchangeable spaced element which can adjust the gap between the cutter 24 and the quill 18. The size of the gap varies with the size and type of wire stock 10 being sheared to maintain optimum cutting quality.

A stop means is provided for engaging one end of the wire stock 10 at a predetermined length in the wire cutting machine. In the illustrated embodiment, a rigid housing 30 having a protruding lip portion 32 supports a threaded receiver 34. The threaded receiver 34 rotatably holds a stock gauge screw 36 which has a slot 38 formed therein at one end. The slot 38 receives a tool used by the operator of the wire cutting machine and allows for easy rotation of the stock gauge screw 36 within the threaded receiver 34. Rotation of the stock gauge screw 36 imparts axial movement thereto, either towards or away from the cutter block 22. The stock gauge pin 28 is held in abutment against the stock gauge screw 36 by a spring 40 supported in the cutter block 22. As the position of the stock gauge screw 36 is changed, the stock gauge pin 28 remains in contact with the screw 36, thus providing a more accurate adjustment. The position of the stock gauge screw 36 and the stock gauge pin 28 determine the length of wire stock 10 which can be admitted into the cutter 24.

Figure 2:
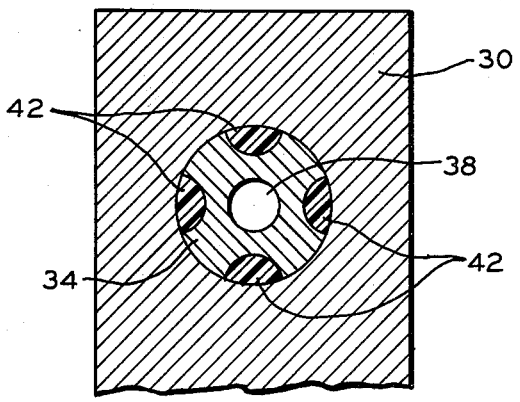
FIG. 2 is an elevational sectional view taken along line 2—2 of FIG. 1.

Interposed between the rigid housing 30 and the threaded receiver 34 is a means for measuring the radial displacement of the stop means. As is illustrated in FIG. 2, a plurality of strain gauges 42 are located within the inner periphery of the rigid housing 30. The strain gauges 42 are mounted in recessed portions of the threaded receiver 34 to protect the gauges 42 and for ease of manufacture. The strain gauges are connected to an appropriate source of an electrical signal (not shown) for measuring the radial displacement of the threaded receiver 34.

In operation, the feed rolls (not shown) frictionally engage the wire stock 10 and advance it axially through the feed tube 12 and the wire guide 14. The leading end of the wire stock 10 passes through the quill 18 and into the cutter 24 until it engages the stock gauge pin 28. The stock gauge pin 28 is in contact with the stock gauge screw 36, which has been set in a predetermined location so as to produce a proper length wire blank when the cutter block 22 is engaged. The stock gauge screw 36 is held in the threaded receiver 34, which is, in turn, securely mounted in the rigid housing 30 by the protruding lip 32. Thus, further axial movement of the wire stock is prevented.

The feed rolls stop turning and the cutter block 22 is raised upwardly, shearing off the wire stock 10 at the stationary quill 18. A punch pin stop (not shown), generally flush with the upper portion of the rigid support 30, engages the stock gauge pin 28 so as to prevent the pin 28 from being pushed out of the cutter block 22 as it rises because of the action of the spring 40. The wire blank is transferred to a first die 44 and the cutter block 22 retracts to its original position. The first die 44 has an associated kickout pin 46 and kickout rod 48 for transferring the workpiece to other die forming areas (not shown).

When the wire stock 10 engages the stock gauge pin 28, pressure is applied axially to the pin 28, the stock gauge screw 36, and the threaded receiver 34 because the wire stock 10 is prevented from moving further axially. In an overfeed situation, the feed rolls continue to turn and force the wire stock 10 into the wire cutting machine, causing the feed rolls to slip on the wire stock 10. Such slippage causes damage to the lubricative coating on the wire stock 10 and increased wear on the grooves of the feed rolls. Because the threaded receiver 34 is secured by the lip 32 of the rigid support 30, the build-up of pressure because of the overfeed is directed radially throughout the threaded receiver 34. The increased pressure and expansion of the threaded receiver 34 is detected by the strain gauges 42 mounted within the rigid housing 30. As the resistivity of the conducting elements of the strain gauges 42 changes with the increased pressure, an electrical signal can be generated which is proportional to the pressure. When the signal exceeds a predetermined maximum level, an overfeed situation is sensed and a signal can be generated to alert the operator or to automatically stop the feed rolls from turning further.

Similarly, if the feed rolls stop turning before the leading end of the wire stock 10 engages the stock gauge pin 28, the cutter block 22 will be engaged too soon and an abnormally short wire blank will be cut off. A short blank can jam in the wire cutting machine and break the dies or other expensive equipment. Because the wire stock 10 does not contact the stock gauge pin 28 in such a situation, no pressure is exerted against the stock gauge screw 36. Thus, no radial displacement of the threaded receiver 34 is effected. An underfeed situation can be detected when the electrical signal passing through the strain gauges 42 does not exceed a predetermined minimum level. A signal can then be generated to an operator or automatically to the feed rolls to effect further rotation of the feed rolls.

Therefore, in the preferred embodiment of the invention, the feed roll actuating means will be responsive to the electrical signals from the strain gauges 42 such that the feed rolls will continue to rotate and project wire stock 10 axially into the wire cutting machine until a predetermined pressure is sensed. At that point, the feed rolls stop turning and the cutter block 22 is engaged to shear off the wire stock 10 at the quill 18.

Figure 3:
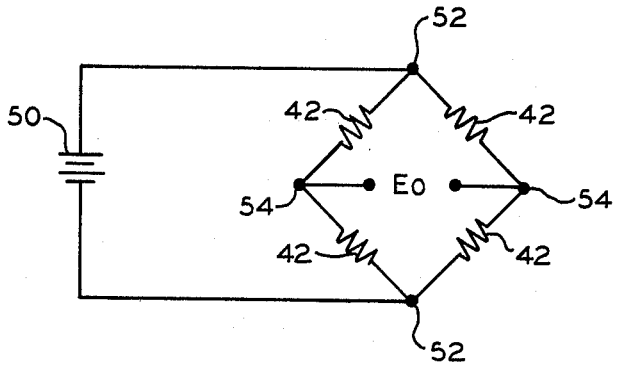
FIG. 3 is a schematic of a strain gauge bridge circuit which can be utilized in the present invention.

There is shown in FIG. 3 a schematic diagram of a full bridge circuit which can be utilized with the present invention. A power supply 50 is connected between a pair of input terminals 52 such that the strain gauges 42 are paired in series in each of two parallel paths between the terminals. The power supply 50 generates the excitation voltage for the strain gauges.

The output voltage Eo of the bridge is measured between a pair of terminals 54 which are the junctions of the strain gauges in the parallel paths between the input terminals 52. The output voltage Eo will have a magnitude which is proportional to the magnitude of the pressure tending to compress the screw 36 and the receiver 34. The voltage Eo may require amplification and/or conditioning before being utilized to indicate the blank length.

Figure 4:
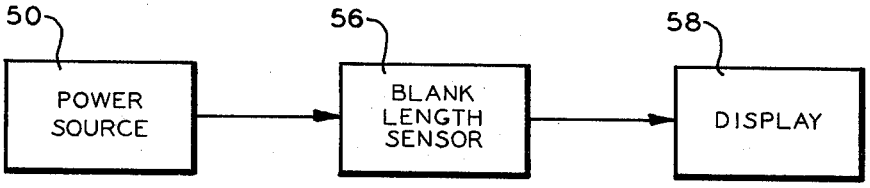
FIG. 4 is a block diagram of a manual control system utilizing the present invention.

In the manual control system shown in FIG. 4, the power source 50 is connected to an input of a blank length sensor 56 which includes the bridge circuit shown in FIG. 3. The output from the sensor 56 represents the length of the blank which would be obtained if the feed means was stopped and a cut made. The output is utilized to drive a display 58 which can be either analog or digital. The machine operator can utilize the information from the display to adjust the point at which the feed means is stopped and the cut is made in order to obtain the desired blank length.

Figure 5:
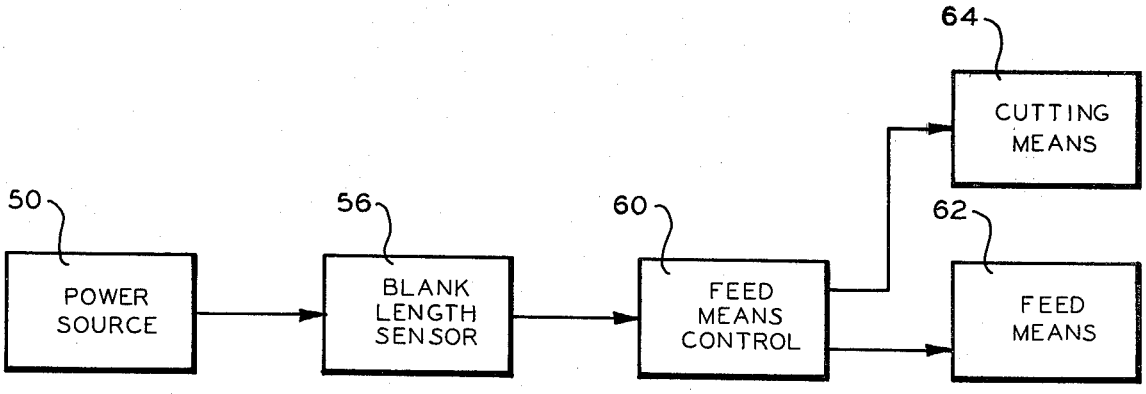
FIG. 5 is a block diagram of an automatic control system utilizing the present invention.

There is shown in FIG. 5, an automatic control system utilizing the power source 50 and the blank length sensor 56. The sensor output is an input to a feed control means 60. The feed control means 60 is connected to the feed means 62 to stop the feed means 62 only when the output signal from the sensor 56 is above a minimum value representing the shortest desired blank length. If the output signal from the sensor 56 exceeds a maximum value before the feed means 62 is stopped, the feed means control 60 can signal the cutting means 64 not to make the cut since an over feed has occurred.

Of course, other control and sensing configurations can be utilized. For example, a half bridge circuit might be utilized to sense the applied pressure.

In accordance with the provisions of the patent statutes, the principle and mode of operation of the present invention have been explained and illustrated in its preferred embodiment. However, it must be understood that the invention can be practiced otherwise than as specifically illustrated without departing from its spirit or scope.

What I claim is:

1. An apparatus for determining the desired cut length for producing wire blanks in a wire cutting machine having feed means for feeding one end of wire stock into the cutting machine, cutting means for cutting wire blanks from the wire stock and stop means for engaging the one end of the wire stock at a predetermined distance from the cutting means, comprising: means responsive to the pressure applied to the stop means by the wire stock for generating a infinitely variable blank length signal representing the magnitude of the applied pressure and means responsive to said blank length signal for controlling the feed means whereby wire blanks of a desired length are cut.

2. The apparatus according to claim 1 wherein said means for generating said blank length signal includes strain gauge means attached to the stop means for generating said blank length signal with a magnitude proportional to the magnitude of the applied pressure.

3. The apparatus according to claim 2 wherein said strain gauge means includes a strain gauge bridge attached to the stop means for sensing pressure applied along the longitudinal axis of the wire stock and having an input connected to a source of electrical power and an output connected to said means for controlling the feed means for generating said blank length signal.

4. The apparatus according to claim 1 wherein the stop means includes a generally cylindrical member having one end rigidly fixed with respect to the cutting means and the other end positioned to receive the pressure applied by the wire stock, said cylindrical member being subject to radial expansion caused by the applied pressure, wherein said means for generating a blank length signal is responsive to the radial expansion of said cylindrical member as said cylindrical member is compressed by the applied pressure.

5. The apparatus according to claim 4 wherein said cylindrical member includes a receiver having a threaded axial aperture formed therein and a screw member threadably received in said threaded aperture, having one end for receiving the applied pressure whereby said receiver and said screw member are radially expanded by the applied pressure.

6. The apparatus according to claim 5 wherein said receiver is cylindrical and said means for generating a blank length signal includes at least two strain gauges attached to the radial peripheral surface of said receiver, a source of power connected to said strain gauges in a bridge circuit for generating an excitation voltage, and wherein said means for controlling the feed means is connected to receive an output voltage generated by said strain gauges in the bridge circuit.

7. The apparatus according to claim 1 wherein said means for generating a blank length signal includes means for adjusting the desired length of the wire blanks attached to the stop means and positioned to engage the one end of the wire stock.

8. The apparatus according to claim 7 wherein said means for adjusting includes a receiver attached to the stop means and having a threaded axial aperture formed therein, and a screw member threadably received in said threaded aperture and having one end for receiving the applied pressure whereby said screw member can be rotated to adjust the distance between the cutting means and the stop means.

9. The apparatus according to claim 8 wherein said means for adjusting includes a stock gauge pin positioned between the one end of said screw member and the one end of the wire stock.

10. A method of determining the desired cut length for producing wire blanks in a wire cutting machine comprising the steps of: (a) feeding one end of wire stock into the wire cutting machine; (b) engaging the one end of the wire stock with a stop means positioned a predetermined distance from a cutting means in the cutting machine; (c) sensing the magnitude of the pressure applied to the stop means by the wire stock by generating an infinitely variable blank length signal representing the magnitude of the applied pressure; and (d) stopping the feeding when the sensed pressure corresponds to the desired blank length.

11. The method of claim 10 wherein said sensing of the magnitude of the pressure applied to the stop means by the wire stock includes utilizing the applied pressure to compress and radially expand the stop means along the axis of the wire stock and sensing the radial expansion of the stop means as an indication of the applied pressure by generating said infinitely variable blank length signal.

* * * * *